United States Patent [19]

Crowe

[11] 4,436,447

[45] Mar. 13, 1984

[54] EROSION CONTROL BLOCKS

[75] Inventor: Robert E. Crowe, Milton, Canada

[73] Assignee: Terrafix Erosion Control Products, Inc., Islington, Canada

[21] Appl. No.: 283,271

[22] Filed: Jul. 14, 1981

[30] Foreign Application Priority Data

Sep. 17, 1980 [CA] Canada ..... 360539

[51] Int. Cl.[3] ..... E02B 3/14

[52] U.S. Cl. ..... 405/16; 52/590; 405/15; 405/32

[58] Field of Search ..... 405/16–35; 52/590, 589

[56] References Cited

U.S. PATENT DOCUMENTS

| | | | |
|---|---|---|---|
| 991,041 | 5/1911 | Toennes | 405/20 |
| 1,460,084 | 6/1923 | Wallis | 52/589 |
| 2,834,186 | 5/1958 | Frerichs et al. | 405/17 |
| 3,076,293 | 2/1963 | Baudoux | 52/589 X |
| 3,116,570 | 1/1964 | Torricelli | 52/590 X |
| 3,220,141 | 11/1965 | Goss | 52/590 X |
| 3,347,048 | 10/1967 | Brown et al. | 405/16 |
| 3,597,928 | 8/1971 | Pilaar | 405/20 |
| 4,201,494 | 5/1980 | Crowe | 405/17 |
| 4,227,834 | 10/1980 | Crowe | 405/17 |

FOREIGN PATENT DOCUMENTS 1037723 9/1978 Canada .

*Primary Examiner*—Dennis L. Taylor

*Attorney, Agent, or Firm*—Ridout & Maybee

[57] ABSTRACT

Interlocking concrete blocks for controlling erosion of banks of bodies of water are provided with improved wave resistance by providing pairs of spigots on one side of the block and a slot or slots on the other side of the block so as to allow longitudinal movement of courses in a bed formed from the blocks while also allowing relative angular movement of adjacent blocks.

8 Claims, 8 Drawing Figures

EROSION CONTROL BLOCKS

FIELD OF THE INVENTION

This invention relates to interlocking concrete blocks used to control erosion of banks defining watercourses or other bodies of water. Such blocks rely partly on their interlocking ability and partly on their weight to provide the required protection.

BACKGROUND OF THE INVENTION

It is well known to protect a bank of a watercourse or natural or artificial lakes by means of a layer of interlocking concrete blocks, preferably overlying a filter mat which further protects the material of the bank for erosion. The present applicant has had extensive experience in the use of such blocks, which are commonly formed with complementary pairs of spigots and sockets, the spigots on the one sides of a course of blocks engaging the sockets on the other sides of the blocks in the next course. If the courses are lapped in the usual manner, the resulting bed of blocks is interlocked in three dimensions, in the manner shown in FIG. 8 of Canadian Pat. No. 957,169. In order to facilitate laying of the blocks, it has also been proposed to use blocks which are tongued and grooved as shown in German Offenlegungschift No. 25.11006. This arrangement provides interlocking in only two dimensions although the extended engagement between adjacent courses tends to compensate for this to some extent. In practice, beds of blocks of these types can prove somewhat deficient in their resistance to wave action such as may occur at the shores of large lakes.

SUMMARY OF THE INVENTION

Surprisingly, I have found that resistance of a bed of interlocked blocks to wave action can be improved by actually reducing the degree of interlocking between the blocks as compared to the prior art systems considered above. More particularly, a concrete erosion control block in accordance with the invention has a pair of longitudinally spaced spigots on one side surface and at least one longitudinally elongated slot in an opposite side surface, the spigots and slot or slots being located to interengage respectively with slots and spigots of blocks laid in adjacent parallel courses. It is believed that the interaction of the spigots and the slots allows better accommodation of the stresses applied to a bed of blocks by wave action and better consolidation of the bed under the influence of such action. By comparison, the conventional spigot and socket construction provides a degree of flexibility of the bed, but little scope for dimensional adjustment in the plane of the bed: tongue and groove arrangements are flexible in one dimension only, whilst flexural stresses will tend to lock the blocks together and prevent longitudinal movement between courses. The slots in the block of the invention may have a limited longitudinal extent and a spacing corresponding to that of the spigots, or a single continuous slot may extend from end to end of the block.

SHORT DESCRIPTION OF THE DRAWINGS

Figure 3:
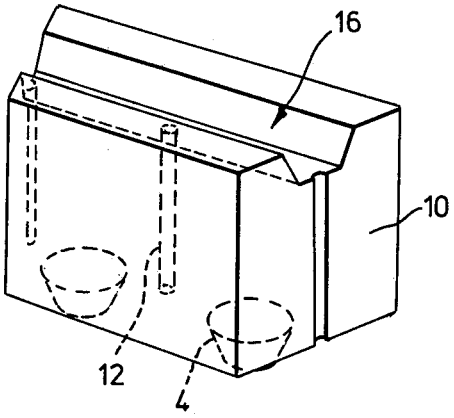
FIGS. 3 and 4 are views similar to FIGS. 1 and 2 of a second embodiment of block in accordance with the invention.
Figure 4:
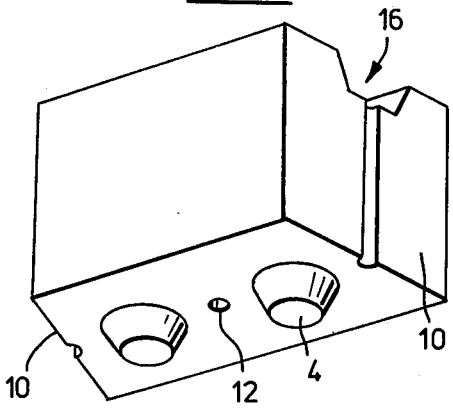
Figure 5:
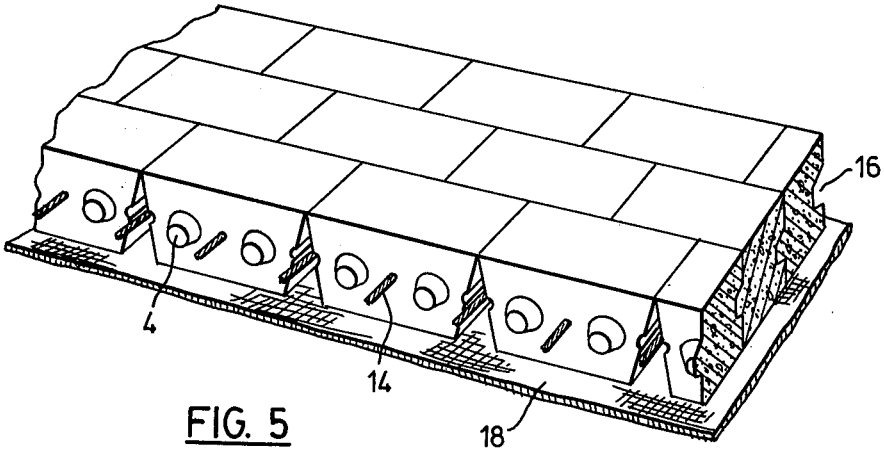
Figure 6:
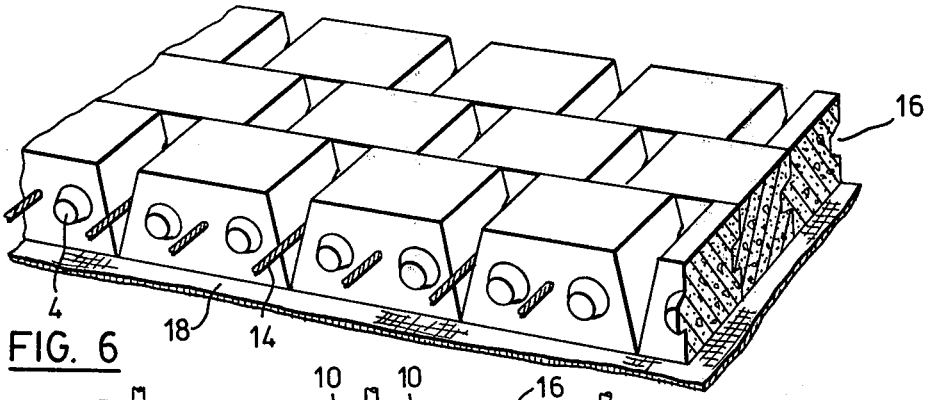
Figure 8:
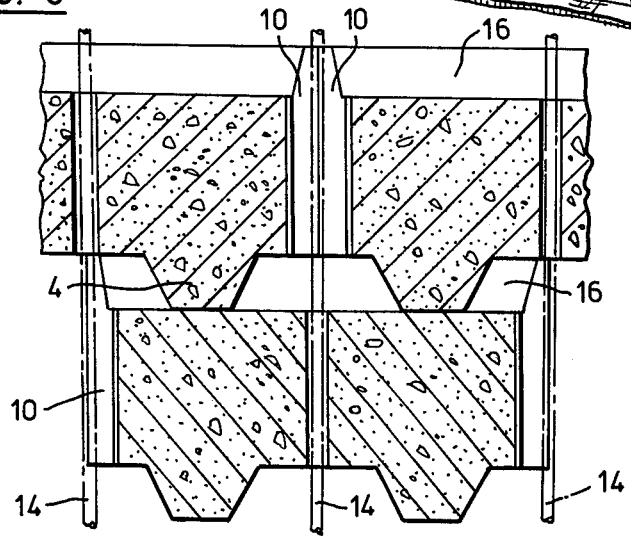
Figure 7:
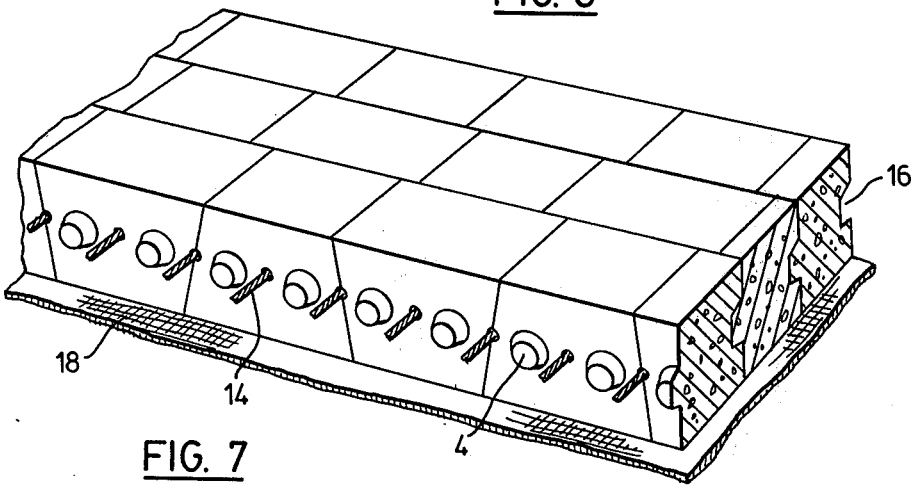

FIGS. 5, 6 and 7 are perspective fragmentary views of blocks in accordance with FIGS. 3 and 4 and arranged in beds of different configuration; and FIG. 8, located between FIGS. 6 and 7, is a horizontal cross-section through part of a bed in accordance with FIG. 5 or 6.

DESCRIPTION OF THE PREFERRED EMBODIMENT

Figure 1:
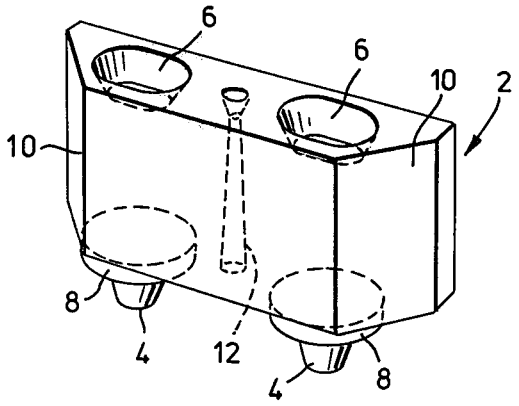
FIG. 1 is a perspective view from one face and one side of a first embodiment of block in accordance with the invention.
Figure 2:
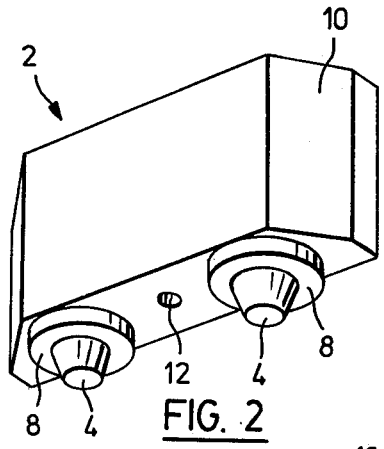
FIG. 2 is a perspective view of the same block from the other face and the other side.

Referring to FIGS. 1 and 2, there is shown an erosion control block which in most respects is similar to blocks already in widespread use. The block 2 has spigots 4 projecting from one side and sockets 6 formed in the other side so that the blocks may be laid in courses in common bond with the spigots of the blocks in one course engaging the sockets of blocks in an adajacent course so as to lock the blocks together in three dimensions. The spigots 4 may be formed on pedestals 8 so as to space apart blocks in adjacent courses and thus provide for ready passage of water between the blocks. Chamfers 10 on the ends of the blocks allow adjustment of the resistance of a bed of blocks to water surges across its surface. If the chambers face upwards in the manner shown in FIG. 6, they form pockets in the bed surface and increase its damping effect upon water surface, whilst if the chamfers face downwards in the manner shown in FIG. 5, the damping effect is reduced. Bores 12 are formed in the blocks to enable anchoring cables 14 to be passed through a bed of blocks in the manner shown in FIGS. 5, 6 and 8.

The difference from conventional blocks lies in the shaping of the sockets 6, which are configured as short slots instead of being a fairly snug fit to the spigots 4. This slot configuration means that a relative longitudinal motion of blocks in adjacent courses becomes possible, and this substantially increases the degree to which the bed can comply with forces tending to bulge it out of its original plane. This compliance is believed to be the principal factor that increases the resistance of the bed to wave action. Prior art beds could not comply to any degree with such bulging forces without disruption and hence failure of the beds. Such compliance may be required both to dissipate the stresses applied by the suction effects caused by wave action, and to compensate for any degree of undermining of the bed that may occur. If the bed can adjust to any minor cavity which forms in the substrate beneath the bed without disruption, both it and the substrate will obviously be less vulnerable to damage than a rigid bed left unsupported by undermining of its support. Improved compliance to the surface of the support also reduces the incidence of undermining. In effect, the blocks can "shuffle" to some extent during use of the bed to maintain its integrity and help dissipate the forces applied to it as well as enabling the blocks to pack more tightly to resist wave action.

The embodiment of block shown in FIGS. 1 and 2 is still limited, as to the longitudinal relationships which can be assumed by blocks in adjacent rows, by the restricted length of the slots forming the sockets 6. In the embodiment of FIGS. 3 and 4, these sockets are replaced by a slot 16 extending the full length of one side of the block. Depending upon the manner of manufacture of the blocks, provision of such a slot may not be practicable in smaller sizes of blocks in that it may reduce the ungrooved area of the side of the block to a point at which this side cannot sustain the handling forces applied to the unset concrete during the process in which the block is cast. The configuration of FIGS. 1 and 2 may therefore be preferred for smaller sizes of blocks, and has the advantage of being compatible with known block designs from which it is developed. The block of FIGS. 3 and 4 has the chambers 10 extended to cover the full depth of the ends of the block, and because of the continuous nature of the slot 16, blocks may be laid in beds of three different configurations as shown in FIGS. 5, 6 and 7. In the FIGS. 5 and 6 configurations the blocks are laid in common bond. The additional configuration 7, in which the blocks are laid in a form of Flemish bond, increases the number of blocks in a given area and hence the mass per unit area of the bed. In all three configurations, the relationship between blocks in adjacent rows is not determined by the necessity for alignment of the spigots with narrow sockets, which makes it easier to lay a bed over a contoured surface without introducing unwanted stresses into the bed. The blocks will normally be laid over a filter mat 18 of bonded fibre laid in turn over a substrate to be protected.

Comparative scale-model tests of both prior art blocks and blocks of the FIGS. 3 and 4 embodiment of this invention in a wind/wave flume under various conditions of wave height, slope and subgrade structure have shown that beds of blocks in accordance with the invention generally show significantly greater resistance to disruption by wave action and improved protection of the subgrade. It was observed that the blocks exhibited significantly greater shifting under the influence of wave action, and adjusted their position both horizontally across the slope and vertically, appearing to pack much more tightly under wave action and thus become more resistant to the waves.

Whilst the blocks of the invention are intended primarily for erosion control purposes, they are also useful for the construction of retaining walls.

What I claim is:

1. A concrete erosion control block having a pair of parallel opposed oblong rectangular outer surfaces, a pair of parallel opposed side surfaces extending lengthwise of said outer surfaces, a pair of longitudinally spaced frustoconical spigots formed on one of said parallel side surfaces and at least one longitudinally elongated slot in the opposite side surface, the spigots and the at least one slot being located to interengage respectively with slots and spigots of similar quincuncially related blocks when the blocks are layed in bond in adjacent parallel courses with their outer surfaces substantially in common planes, whereby to permit relative movement of said courses in a direction parallel to said side surfaces and relative angular movement between adjacent blocks in both the same and adjacent courses, whilst restraining movement of individual blocks out of said common planes.

2. A block according to claim 1, wherein there are two slots having a limited longitudinal extent and a spacing corresponding to that of the spigots.

3. A block according to claim 1, wherein a single continuous slot extends across said opposite side surface from end to end of the block.

4. A block according to claim 3, wherein the block has oppositely inclined end surfaces such that the outer surfaces of unequal length.

5. A bed of blocks according to claim 4, wherein the blocks are laid in common bond with their longer outer surfaces uppermost.

6. A bed of blocks according to claim 4, wherein the blocks are laid in common bond with their shorter outer surfaces uppermost.

7. A bed of blocks according to claim 4, wherein the blocks are laid in bond with their ends in contact with their shorter and longer upper surfaces alternating in each course.

8. A bed according to claim 5, 6 or 7, laid on a filter mat, overlying a substrate to be protected.

* * * * *